US007617846B2

(12) United States Patent
Ding

(10) Patent No.: US 7,617,846 B2
(45) Date of Patent: Nov. 17, 2009

(54) INDUSTRIAL FABRIC, AND METHOD OF MAKING THEREOF

(75) Inventor: John Ding, Guangzhou (CN)

(73) Assignee: Albany International Corp., Albany, NY (US)

( * ) Notice: Subject to any disclaimer, the term of this patent is extended or adjusted under 35 U.S.C. 154(b) by 152 days.

(21) Appl. No.: 11/492,529

(22) Filed: Jul. 25, 2006

(65) Prior Publication Data

US 2008/0023096 A1 Jan. 31, 2008

(51) Int. Cl.

| | |
|---|---|
| ***D03D 3/04*** | (2006.01) |
| ***D21F 7/10*** | (2006.01) |
| ***D21F 7/08*** | (2006.01) |
| *D03D 25/00* | (2006.01) |

(52) U.S. Cl. ..... 139/383 A; 139/383 AA; 139/383 R; 162/358.2

(58) Field of Classification Search ..... 139/383 A, 139/383 AA

See application file for complete search history.

(56) References Cited

U.S. PATENT DOCUMENTS

| | | | | | |
|---|---|---|---|---|---|
| 2,003,123 | A | * | 5/1935 | Specht | 245/8 |
| 4,290,209 | A | | 9/1981 | Buchanan et al. | |
| 4,297,749 | A | * | 11/1981 | Davis et al. | 623/2.19 |
| 4,340,091 | A | * | 7/1982 | Skelton et al. | 139/383 R |
| 4,438,788 | A | | 3/1984 | Harwood | |
| 4,438,789 | A | | 3/1984 | MacBean | |
| 4,621,663 | A | | 11/1986 | Malmendier | |
| 4,755,420 | A | | 7/1988 | Baker et al. | |
| 5,066,532 | A | | 11/1991 | Gaisser | |
| 5,114,777 | A | | 5/1992 | Gaisser | |
| 5,169,499 | A | * | 12/1992 | Eagles et al. | 428/175 |
| 5,254,398 | A | | 10/1993 | Gaisser | |
| 5,458,161 | A | | 10/1995 | Scarfe | |
| 5,465,764 | A | | 11/1995 | Eschmann et al. | |
| 5,503,196 | A | | 4/1996 | Josef et al. | |
| 5,713,398 | A | * | 2/1998 | Josef | 139/383 A |
| 5,769,131 | A | | 6/1998 | Whitlock et al. | |
| 5,799,708 | A | * | 9/1998 | Josef | 139/383 A |
| 5,819,811 | A | | 10/1998 | Baker et al. | |
| 5,857,497 | A | | 1/1999 | Gaisser | |
| 6,189,577 | B1 | | 2/2001 | Lee | |
| 6,329,051 | B1 | * | 12/2001 | Groh et al. | 428/360 |

(Continued)

FOREIGN PATENT DOCUMENTS

| | | | |
|---|---|---|---|
| EP | 0 612 882 | A | 8/1994 |

*Primary Examiner*—Bobby H Muromoto, Jr.
(74) *Attorney, Agent, or Firm*—Frommer Lawrence & Haug LLP; Ronald R. Santucci; Vivek Shankam

(57) ABSTRACT

A papermakers's fabric which includes a system of CD yarns including a plurality of CD yarns and a system of MD yarns. The system of MD yarns further includes a first subsystem of MD yarns and a second subsystem of MD yarns, which are in a vertically stacked relationship with one another. The first subsystem of MD yarns includes sheds having at least two MD yarns with substantially similar aspect ratios. The aspect ratio of the MD yarns in the second subsystem of MD yarns is greater than that of the MD yarns in the first subsystem of MD yarns. All of the yarns the first and second subsystems of MD yarns are interwoven with the CD yarns of the CD yarn system in a repeat weave pattern. Seaming loops are formed using only MD yarns from the first subsystem of MD yarns.

45 Claims, 12 Drawing Sheets

U.S. PATENT DOCUMENTS

| | | | | |
|---|---|---|---|---|
| 6,431,221 | B1 | 8/2002 | Wrigley | |
| 7,300,554 | B2 * | 11/2007 | LaFond et al. | 162/348 |
| 2003/0084953 | A1 * | 5/2003 | Burazin et al. | 139/383 A |
| 2004/0003861 | A1 * | 1/2004 | Best et al. | 139/383 A |
| 2004/0089363 | A1 * | 5/2004 | Josef et al. | 139/383 A |
| 2004/0089364 | A1 * | 5/2004 | Josef et al. | 139/383 A |
| 2004/0154683 | A1 * | 8/2004 | Majaury et al. | 139/383 A |
| 2004/0206414 | A1 * | 10/2004 | Festor | 139/383 A |
| 2004/0221914 | A1 * | 11/2004 | Martin | 139/383 A |
| 2004/0261883 | A1 * | 12/2004 | Harrison | 139/383 A |
| 2004/0261884 | A1 * | 12/2004 | Rydin | 139/383 A |

* cited by examiner

CD →

MD →

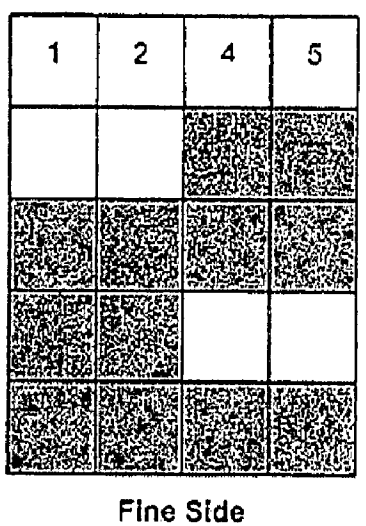
Figure 8a
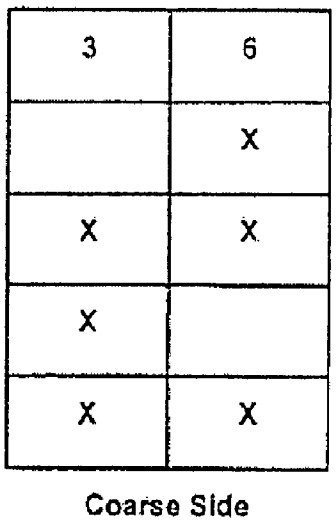
Figure 8b
Figure 8c

INDUSTRIAL FABRIC, AND METHOD OF MAKING THEREOF

BACKGROUND OF THE INVENTION

1. Field of the Invention

The present invention relates to the papermaking arts. More specifically, the present invention is a papermaker's or dryer fabric for use on the dryer section of a paper machine, such as on a single-run dryer section.

2. Background of the Invention

During the papermaking process, a cellulosic fibrous web is formed by depositing a fibrous slurry, that is, an aqueous dispersion of cellulose fibers, onto a moving forming fabric in the forming section of a papermaking machine. A large amount of water is drained from the slurry through the forming fabric, leaving the cellulosic fibrous web on the surface of the forming fabric.

The newly formed cellulosic fibrous web proceeds from the forming section to a press section that includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The web, now a paper sheet, finally proceeds to a dryer section, which includes at least one series of rotatable dryer drums or cylinders, which are internally heated by steam. The newly formed paper sheet is sequentially directed in a serpentine path around each in the series of drums by one or more dryer fabrics, which hold the paper sheet closely against the surfaces of the drums. The heated drums reduce the water content of the paper sheet to a desirable level through evaporation.

It should be appreciated that forming, press and dryer fabrics all take the form of endless loops on the papermaking machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

The instant invention relates primarily to a dryer fabric for use in the drying section of a papermaking machine. In a dryer section, the dryer cylinders may be arranged in a top and a bottom row or tier. Those in the bottom tier may be staggered relative to those in the top tier, rather than being in a strict vertical relationship. As the sheet proceeds through the dryer section, it may pass alternately between the top and bottom tiers, first passing around a dryer cylinder in one of the two tiers and then passing around a dryer cylinder in the other tier, and so on sequentially through the dryer section. As depicted in FIG. 1*a*, in dryer sections, the top 94 and bottom 96 tiers of dryer cylinders may each be clothed with a separate dryer fabric 99. In such a situation, paper sheet 98 being dried passes unsupported across the space, or "pocket", between each dryer cylinder and the next dryer cylinder on the other tier.

In a single tier dryer section, a single row of cylinders along with a number of turning cylinders or rolls may be used. The turning rolls may be solid or vented. In a single-tier dryer section, such as that shown in FIG. 1*b*, a paper sheet 198 is transported by use of a single dryer fabric 199 which follows a serpentine path sequentially about dryer cylinders 200 in the top and bottom tiers.

In order to increase production rates and minimize disturbance to the sheet, single-run dryer sections are used to transport the sheet being dried at high speeds. In a single-run dryer section, a single dryer fabric follows a serpentine path sequentially about the dryer cylinders in the top and bottom tiers.

It will be appreciated that, in a single-run dryer section, the dryer fabric holds the paper sheet being dried directly against the dryer cylinders in one of the two tiers, typically the top tier, but also carries it around the dryer cylinders in the bottom tier. The fabric return run is above the top dryer cylinders. On the other hand, some single-run dryer sections have the opposite configuration in which the dryer fabric holds the paper sheet directly against the dryer cylinders in the bottom tier, but also carries it around the top cylinders. In this case, the fabric return run is below the bottom tier of cylinders. In either case, a compression wedge is formed by air carried along by the backside surface of the moving dryer fabric in the narrowing space where the moving dryer fabric approaches a dryer cylinder. The resulting increase in air pressure in the compression wedge causes air to flow outwardly through the dryer fabric. This air flow, in turn, forces the paper sheet away from the surface of the dryer fabric, a phenomenon known as "drop off". "Drop off" can reduce the quality of the paper product being manufactured by causing edge cracks and can also cause sheet breaks, which reduces machine efficiency.

Many paper mills have addressed this problem by machining grooves into the dryer cylinders of the lower tier or by adding a vacuum source to those dryer cylinders. Although both are expensive, both of these expedients allow the air otherwise trapped in the compression wedge to be removed without passing through the dryer fabric. Furthermore, non-sheet marking and sheet contact with the dryer cylinder surface are requirements as well as good wear resistance and dimensional stability.

As previously discussed, it should be appreciated that the forming, press and dryer fabrics all take the form of endless loops on the paper machine and function in the manner of conveyors. A seam, such as a seam which may be used to close a fabric into endless form during installation on a papermaking machine, represents a discontinuity in the uniform structure of the fabric. The use of a seam, then, greatly increases the likelihood that the cellulosic fibrous web will be marked during the drying process.

For this reason, a seam is generally a critical part of a seamed fabric because uniform paper quality, low marking and excellent runnability of the fabric require a seam which is as similar as possible to the rest of the fabric in respect of properties such as thickness, structure, strength, permeability etc. Consequently, the seam region of any workable on-machine-seamable fabric must behave similar to the body of the fabric, and should have similar permeability to water vapor and to air as the rest of the fabric in order to prevent the periodic marking by the seam region of the paper product being manufactured.

Despite the considerable technical obstacles presented by these requirements, it remained highly desirable to develop on-machine-seamable fabric because of the comparative ease and safety with which such a fabric could be installed on a papermaking machine. Furthermore, in the dryer section, fabrics must have a seam to allow installation. Ultimately, these obstacles were overcome with the development of fabrics having seams formed by providing seaming loops on the crosswise edges of the two ends of the fabric. The seaming loops themselves are formed by the machine-direction (MD) yarns of the fabric. A seam is formed by bringing the two ends of the fabric together, by interdigitating the seaming loops at the two ends of the fabric, and by directing a so-called pin, or pintle, through the passage definerd by the interdigitated seaming loops to lock the two ends of the fabric together. Needless to say, it is much easier and far less time-consuming to install an on-machine-seamable fabric, than it is to install an endless fabric, on a papermaking machine.

One method of producing a fabric that can be joined on a papermaking machine with such a seam is to flat-weave the fabric. In this case, the warp yarns are the machine-direction (MD) yarns of the fabric. To form the seaming loops, the warp yarns at the ends of the fabric are turned back and woven back some distance into the fabric body in a direction parallel to the warp yarns.

In some cases, spiral seaming coils may be attached to the seaming loops at the ends of the fabric by, for example, interdigitating the individual turns of a spiral seaming coil with the seaming loops via a pin or another CD (cross machine direction) body yarn at each end of the fabric and by directing a pintle through the passage formed by the interdigitated yarns and seaming loops to join the spiral seaming coil to the end of the fabric. Then, the fabric may be joined into the form of an endless loop by interdigitating the individual turns of the seaming coils at each end of the fabric with one another, and by directing another pintle through the passage formed by the interdigitated seaming coils to join the two ends of the fabric to one another. As known to those skilled in the art, many varieties of industrial fabrics are designed to be closed into endless form during installation on some equipment.

Besides dryer fabrics, other industrial fabrics, such as corrugator belts, pulp-forming fabrics and sludge-dewatering belts are, or can be, seamed in similar fashion. In these fabrics, where the MD yarn is also the seam loop, it is well known that bending a yarn, especially a single monofilament, around a small radius to form a loop, stresses and weakens the yarn in the loop area. The whole seam is then weaker than the main fabric body in use. Since the seam loops are load bearing and are flexed repeatedly (and in some cases also compressed) during use, any machine upset can lead to premature seam failure and fabric removal.

An important aspect of seaming a fabric on a papermaking machine is that there be uniform tension across the fabric. If uniform tension is not achieved and one section of the fabric pulls more than another, then the fabric can bubble or ridge across the fabric width.

Another aspect of seaming a fabric is preventing damage to the fabric body. In order to avoid or minimize the chance of damage to the fabric during installation, non-uniform tension, weight and pressure must be avoided on the seam itself. A further aspect of seaming a fabric, especially very long ones is properly aligning the fabric body in the machine so the fabric guides true in the machine direction and does not oscillate or track to one side of the machine. If the fabric guides or tracks poorly it can make contact with the paper machine support frame and cause fabric damage.

Consequently, seaming a conventional dryer fabric on a papermaking machine is a difficult and tedious process. Therefore, a need exists for a dryer fabric that can be installed and seamed quickly and easily. In addition to being installed easily and quickly, the instant dryer fabric is both durable and provides a smooth sheet contacting surface in both the fabric body and the seam region, resulting in less marking and thus higher quality of a paper sheet being manufactured thereon.

SUMMARY OF THE INVENTION

It is therefore a principal object of the invention to provide a dryer fabric that can be easily installed on a papermaking machine.

It is a further object of the invention to provide a dryer fabric that is both durable and has a finer sheet contacting surface than those in the prior art.

Yet another object of the invention is to provide an on-machine-seamable dryer fabric that has a seam, which does not mark a paper product being formed thereon.

A further object of the invention is to provide a dryer fabric that has a coarse backside surface and a finer sheet contacting side surface.

These and other objects and advantages are provided by the instant invention. In this regard, according to one embodiment, the instant invention is directed to a papermaker's fabric and a method for forming a papermaker's fabric, and more specifically, to a dryer fabric. The papermaker's fabric comprises a system of CD yarns that includes a plurality of CD yarns and a system of MD yarns. The system of MD yarns further comprises a first subsystem of MD yarns and a second subsystem of MD yarns, which are in a vertically stacked relationship with one another. The first subsystem of MD yarns includes sheds comprising at least two MD yarns having substantially similar or even the same aspect ratios. The aspect ratio of the MD yarns in the second subsystem of MD yarns is greater than that of the MD yarns in the first subsystem of MD yarns. All of the yarns in the first and second subsystems of MD yarns are interwoven with the CD yarns from the CD yarn system in a repeat weave pattern. Lastly, seaming loops are formed only using MD yarns from the first subsystem of MD yarns.

The various features of novelty which characterize the invention are pointed out in particularity in the claims annexed to and forming a part of this disclosure. For a better understanding of the invention, its operating advantages and specific objects attained by its uses, reference is made to the accompanying descriptive matter in which preferred embodiments of the invention are illustrated in the accompanying drawings in which corresponding components are identified by the same reference numerals.

BRIEF DESCRIPTION OF THE DRAWINGS

The following detailed description, given by way of example and not intended to limit the present invention solely thereto, will be best appreciated in conjunction with the accompanying drawings, wherein like reference numerals denote like elements and parts, in which:

FIG. 8*a* is a weave pattern of a papermaker's fabric according to one embodiment of the present invention;

FIG. 8*b* is the weave pattern for only the backside or machine side warp yarns for the fabric weave pattern depicted in FIG. 8*a* FIG. 8*c* is the weave pattern for only the paired sheet contacting side warp yarns for the fabric weave pattern depicted in FIG. 8*a;*

DETAILED DESCRIPTION OF THE PREFERRED EMBODIMENTS

Figure 1A:
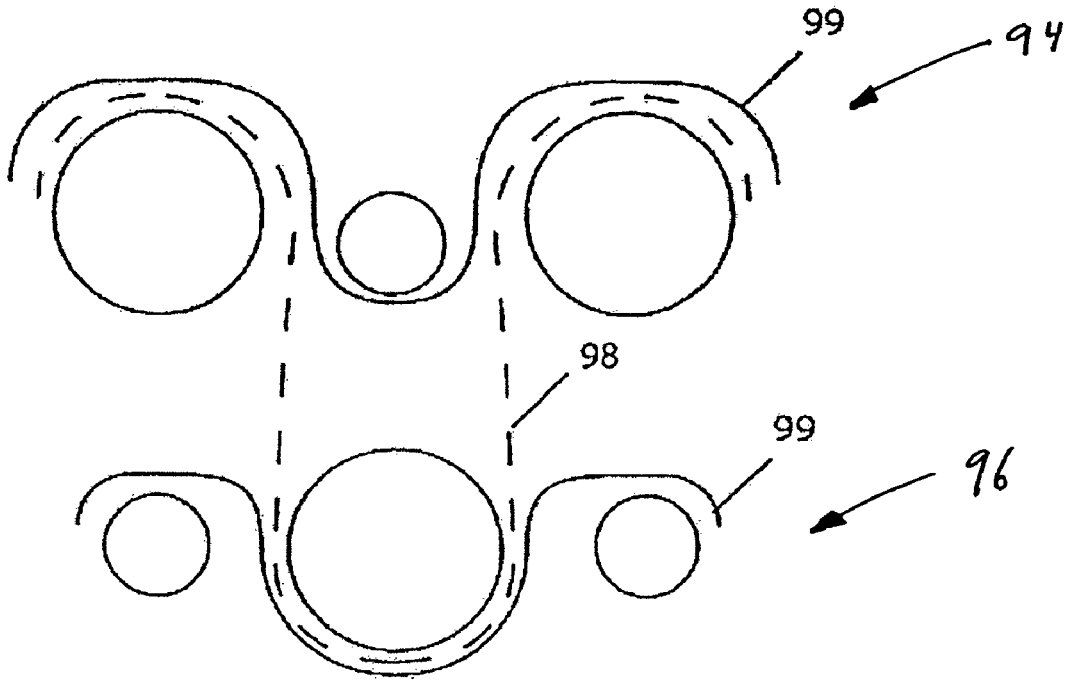
FIG. 1*a* is a schematic diagram of a two-tiered dryer section of a papermaking machine.
Figure 1B:
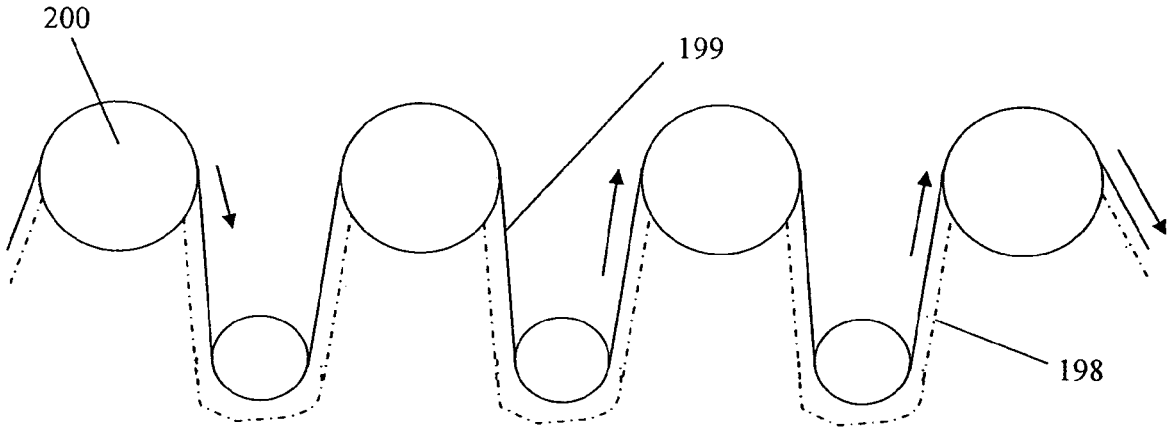
FIG. 1*b* is a schematic diagram of a single tier dryer section of a papermaking machine.

The instant invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art.

The instant invention relates to full width, full length seamed endless papermaking fabrics for use in a dryer section of a papermaking machine. The papermaker's fabric according to one embodiment of the present invention includes a system of warp yarns or machine direction ("MD") yarns and a system of shute yarns or cross-machine direction ("CD") yarns. All of the warp yarns in the system of warp yarns have a non-round or substantially rectangular (flat) cross-section. The shute or CD yarns can either have a round, substantially rectangular or any other cross-sectional shape. If the shute yarns are round, they can typically have a diameter of 0.70 mm to 0.80 mm. It is important to note that the shute yarns do not all have to have the same shape. Also, different diameter shute yarns can be used in the same fabrics.

The yarns that comprise the fabrics of the present invention may be monofilament yarns of any of the synthetic polymeric resins used in the production of such yarns for papermaking machine clothing. Polyester and polyamide are but two examples of such materials. However, additional examples of such materials are other polymers such as polyphenylene sulfide (PPS), which is commercially available under the name RYTON®, and a modified heat, hydrolysis and contaminant resistant polyester of the variety disclosed in commonly assigned U.S. Pat. No. 5,169,499, the contents of which are incorporated herein by reference, and used in dryer fabrics sold by Albany International Corp. under the trademark THERMONETICS®. Further, materials such as poly (cyclohexanedimethylene terephthalate-isophthalate) (PCTA), polyetheretherketone (PEEK) and others could also be used. Both MD and CD yarns can be made either of the same or different materials.

As used herein, the terms upper layer, upper layer warp yarns, finer warp yarns, sheet contacting side or face side surface warp yarns and the first subsystem of warp yarns are used interchangeably and are not meant to limit the use of the instant invention. Additionally, as used herein, the terms lower layer, lower layer warp yarns, coarse warp yarns, backside, roll side or machine side or backside surface warp yarns and the second system of warp yarns are used interchangeably and are not meant to limit the use of the instant invention. Lastly, as used herein, the terms MD yarns and warp yarns are used interchangeably and the terms CD yarns, weft yarns, shutes or shute yarns and filling yarns are used interchangeably and are not meant to limit the use of the instant invention. In the following description, like reference characters designate like or corresponding parts throughout the figures.

The present fabric is flat woven, therefore, the warp yarns are the longitudinal or MD yarns and the shute or weft yarns are the CD yarns. The system of warp or MD yarns further comprises two subsystems of warp or MD yarns. The first subsystem of warp yarns includes upper layer or sheet contacting side warp yarns and the second subsystem of warp yarns includes lower layer or back or machine side warp yarns. The machine side warp yarns include weaving shed patterns comprising individual warp yarns and the sheet contacting side warp yarns includes weaving shed patterns comprising at least two warp yarns in a side-by-side relationship. In the resulting fabric weave, the first and second subsystems of warp yarns are vertically stacked one on top of the other. The width of each individual warp yarn in the first subsystem or upper layer of warp yarns are finer or narrower than the width of the warp yarns in the second subsystem of warp yarns, such that the combined width of the upper layer warp yarns in each shed is essentially equal to the width of each single machine side or bottom layer warp yarn. Consequently, the upper layer warp yarns are finer or narrower yarns and the bottom layer warp yarns are coarser or wider yarns. Therefore, the individual yarns in the first subsystem of warp yarns, have a different aspect ratio (the width to height ratio of each individual yarn) than the aspect ratios of each individual yarn in the second subsystem of warp yarns. For example, the dimensions of a finer upper layer warp yarn may be 0.31 mm high by 0.58 mm wide and the dimensions of a coarser bottom layer warp yarn may be 0.28 mm high by 1.16 mm wide.

Figure 2A:
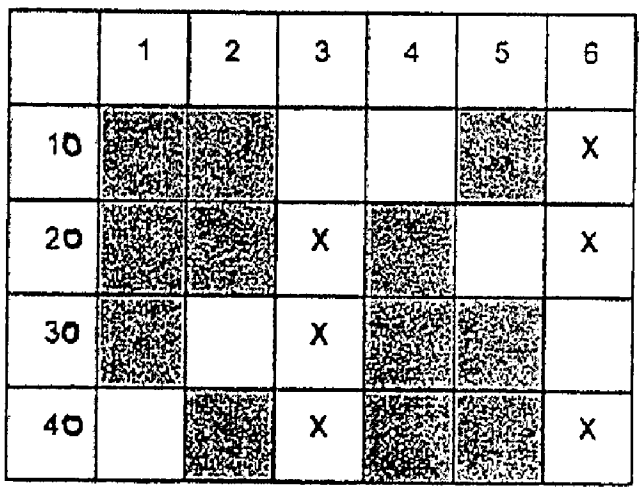
FIG. 2*a* is a weave pattern of a papermaker's fabric according to one embodiment of the present invention.

Referring now to the figures, FIG. 2*a* depicts a weave pattern or design for a papermaker's fabric according to a first embodiment of the present invention. The machine direction and cross-machine direction are as indicated in the figure and result in the MD yarns being identified along the top of the weave pattern and the shute or CD yarns being identified along the left side of the weave pattern. For purposes of this discussion, we will assume that each shed in the first subsystem of warp yarns comprises a pair of side-by-side warp yarns having a combined width essentially equal to the width a warp yarn in the second subsystem of warp yarns.

FIG. 2*a* shows one repeat of the weave pattern of a papermaker's fabric in which, warp yarn 1, which is one of the pair of finer warp yarns in a shed of the upper layer of warp yarns, weaves under shute yarn 40 and over shute yarns 10, 20 and 30. Warp yarn 2, which is a finer warp yarn in a shed of the upper layer of warp yarns that is adjacent to and paired with warp yarn 1, weaves over shute yarn 40, under shute yarn 30 and over shute yarns 10 and 20. Lower layer coarse warp yarn 3 weaves over shute yarns 20, 30 and 40 and under shute yarn 10. Warp yarn 4, which is one of the pair of finer warp yarns of an adjacent pair in the upper layer of warp yarns, weaves on the sheet contacting side of the fabric over shute yarns 20, 30 and 40, and under shute yarn 10. Warp yarn 5, which is a finer yarn in the upper layer of warp yarns that is adjacent to and paired with warp yarn 4, weaves over shute yarns 30 and 40, under shute yarn 20 and over shute yarn 10. Lastly, in a repeat, lower layer coarse warp yarn 6 weaves over shute yarn 40, under shute yarn 30, and over shute yarns 10 and 20. The fabric may also be woven using additional harness repeat arrangements, such as, for example, a 4 or a 6 harness repeat. In all cases, pairs of sheet side MD yarns are vertically stacked above a single larger backside MD yarn. The pair of upper warp or MD yarns in this embodiment is "staggered," i.e. they do not weave together in the same pattern over and under the CD yarns. Instead, as detailed in FIGS. 2*a*, 2*b* and 2*c*, each warp yarn in the pair weaves under a different CD yarn.

A fabric woven according to the weaving structure depicted in FIG. 2*a* results in a more durable fabric because of the coarse warp yarns on the machine side of the fabric and has the added advantage of having a very smooth fabric or sheet contacting surface. Thus, this type of fabric can be used for paper grades of, for example, 30 gsm or above because it will not mark a sheet formed thereon.

Figure 2B:
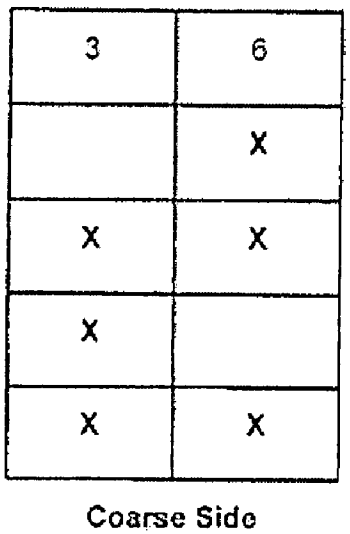
FIG. 2*b* is the weave pattern for only the back or machine side warp yarns for the fabric weave pattern depicted in FIG. 2*a;*
Figure 2C:
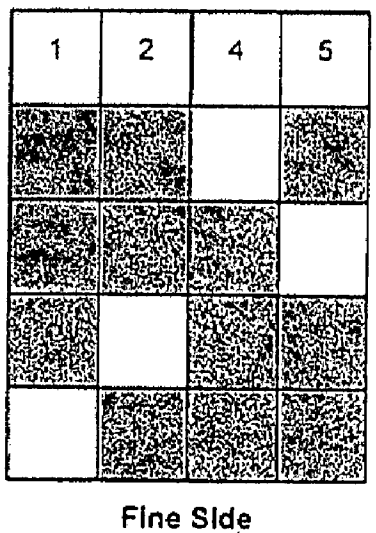
FIG. 2*c* is the weave pattern for only the paired sheet contacting side warp yarns for the fabric weave pattern depicted in FIG. 2*a;*

The weave design for the machine side and sheet contacting side of the fabric are separately depicted in FIGS. 2*b* and 2*c*, respectively, in order to show a comparative warp fill on the machine and sheet contacting sides of the fabric. For example, the width of the machine side coarse warp yarns can be approximately equal to twice the width of each finer sheet contacting side warp yarn or at least equal to the width of each pair of sheet contacting side warp yarns. FIG. 2*b* shows coarse yarns 3 and 6, each being in a separate shed in the lower layer of warp yarns, while FIG. 2*c* shows two sheds in the upper layer of warp yarns, one comprising upper warp yarns 1 and 2 and the other comprising upper warp yarns 4 and 5.

The weave pattern depicted in FIGS. 2*a*, 2*b* and 2*c* can be seen throughout the face side of the fabric structure, except for portions in the seaming area on the backside of the fabric where the upper warp yarns abut lower coarser warp yarns. The fabric structure in the seam region that forms the seaming loops will be discussed later.

A variety of additional weave patterns employing the paired, vertically stacked warp yarn system of the instant invention may be constructed within the scope of the present invention. For example, in some applications, it may be desirable to have MD or warp yarn surface floats for the upper layer warp yarns over four or more CD or weft yarns. Such fabrics are readily constructed in accordance with the teachings of the present invention.

Figure 3:
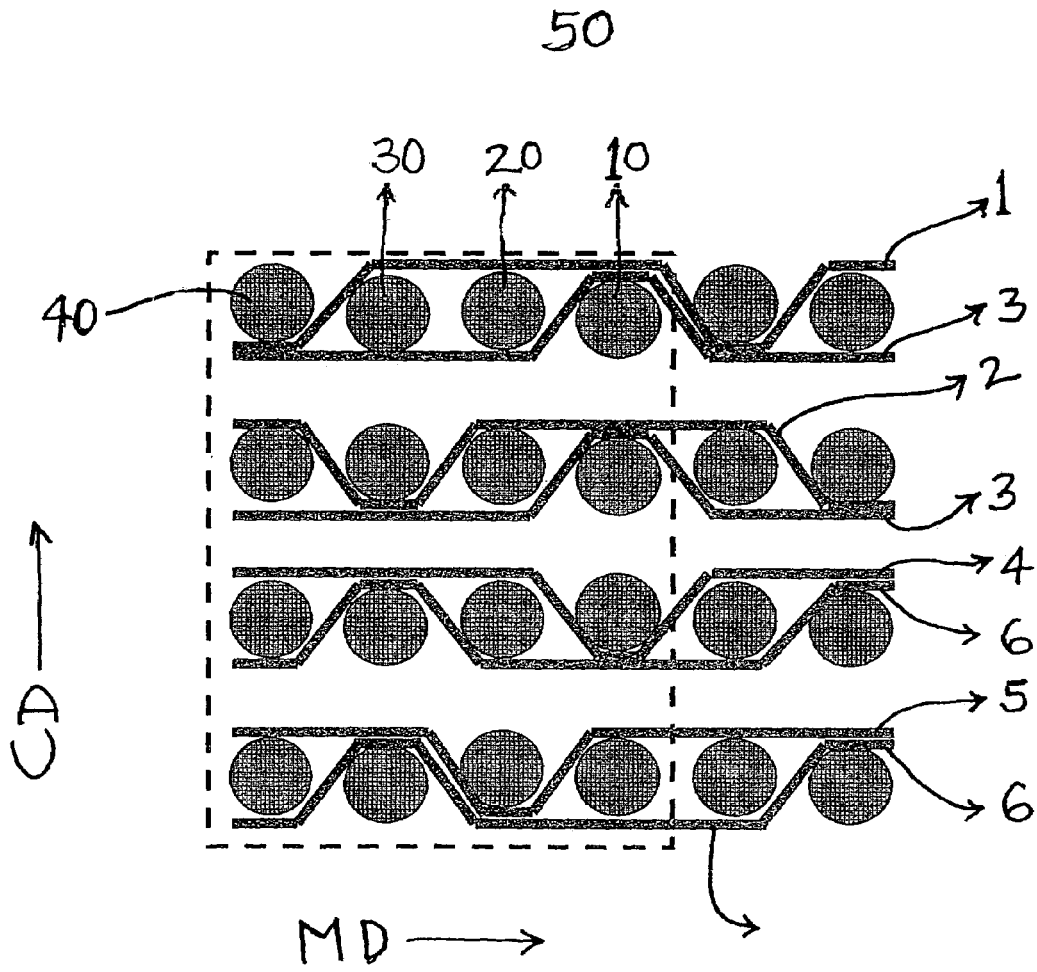
FIG. 3 is a side view in the cross-machine direction of the weave pattern depicted in FIG. 2.

FIG. 3 is a side view in the cross-machine direction of the weave pattern for the fabric depicted in FIG. 2*a*. As can be seen in FIG. 3, the fabric includes two layers of MD or warp yarns. Because, as previously discussed, the fabric is flat woven and subsequently joined into endless form with a seam, the CD yarns are weft or filling yarns and the MD yarns are warp yarns. A first set of MD yarns, the upper layer or sheet contacting side warp yarns, includes finer MD or warp yarns 1, 2, 4, 5, while a second set of MD yarns, the machine side warp yarns, includes coarse MD or warp yarns 3 and 6. As is apparent in FIGS. 2*a*, 2*b*, 2*c* and 3, the warp yarns in these two sets are stacked one on top of the other in a vertical relationship. Furthermore, in FIG. 3, the CD yarns are depicted by structures 10, 20, 30 and 40.

Figure 4:
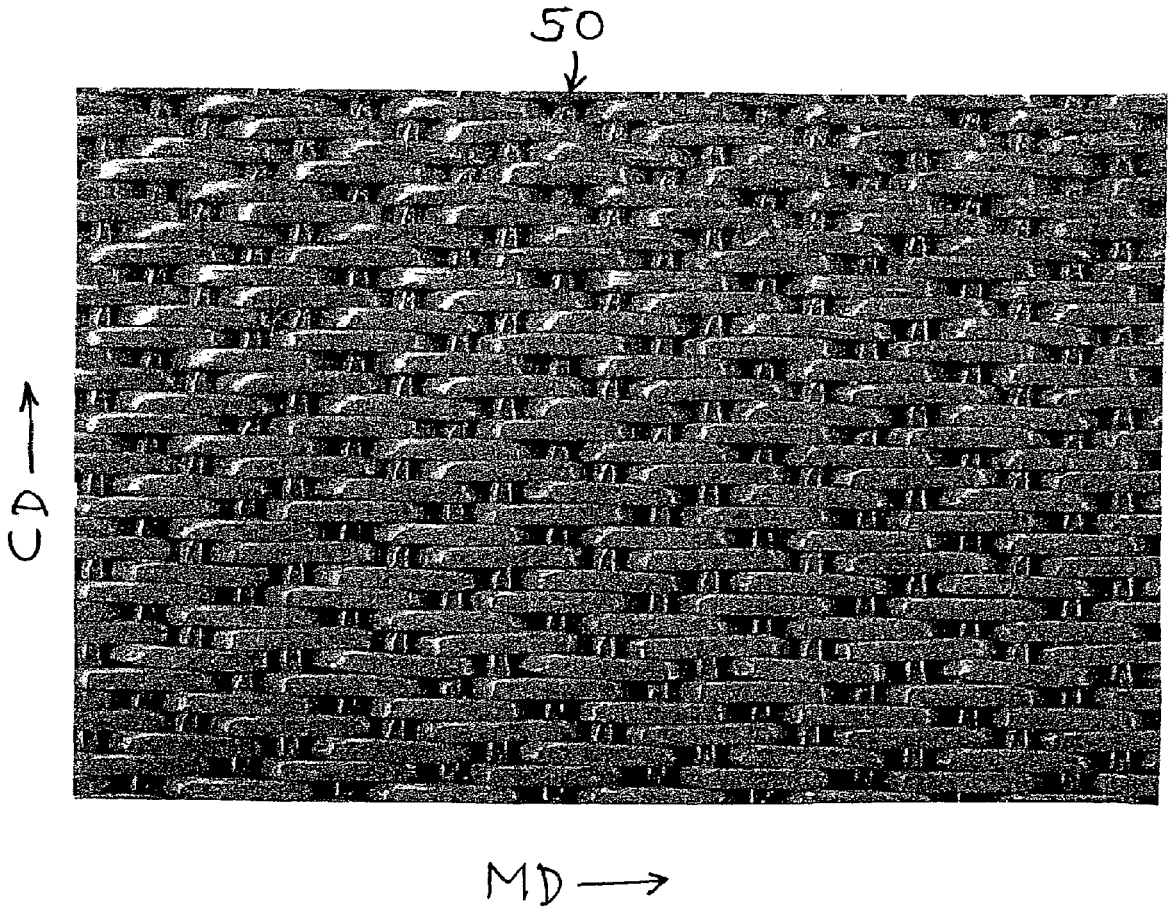
FIG. 4 is a surface photograph of the sheet contacting side of a papermaker's fabric according to one embodiment of the present invention.

Returning now to FIGS. 2*a*, 2*b* and 2*c*, warp yarns 1-6 may be flat monofilament yarns having substantially rectangular cross-sections. The flat, substantially rectangular shape of the finer sheet contacting side warp yarns can be seen in FIG. 4, which depicts the sheet contacting warp yarns of a fabric 50 constructed in accordance with the first embodiment of the instant invention. Also, as can be seen in FIG. 4, the finer, substantially rectangular sheet contacting side warp yarns are arranged in groups of two, in which two upper warp yarns are paired and woven with the CD yarns. Lastly, as can be seen in FIG. 4, the pair of upper layer weft yarns are "staggered" in the machine direction. That is, they do not weave together in the same pattern over and under each CD yarn. Instead, each yarn in the pair weaves under the next adjacent CD yarn in the machine direction. Therefore, the paired warp yarns in the upper layer form a staggered pattern in the machine direction.

Figure 5:
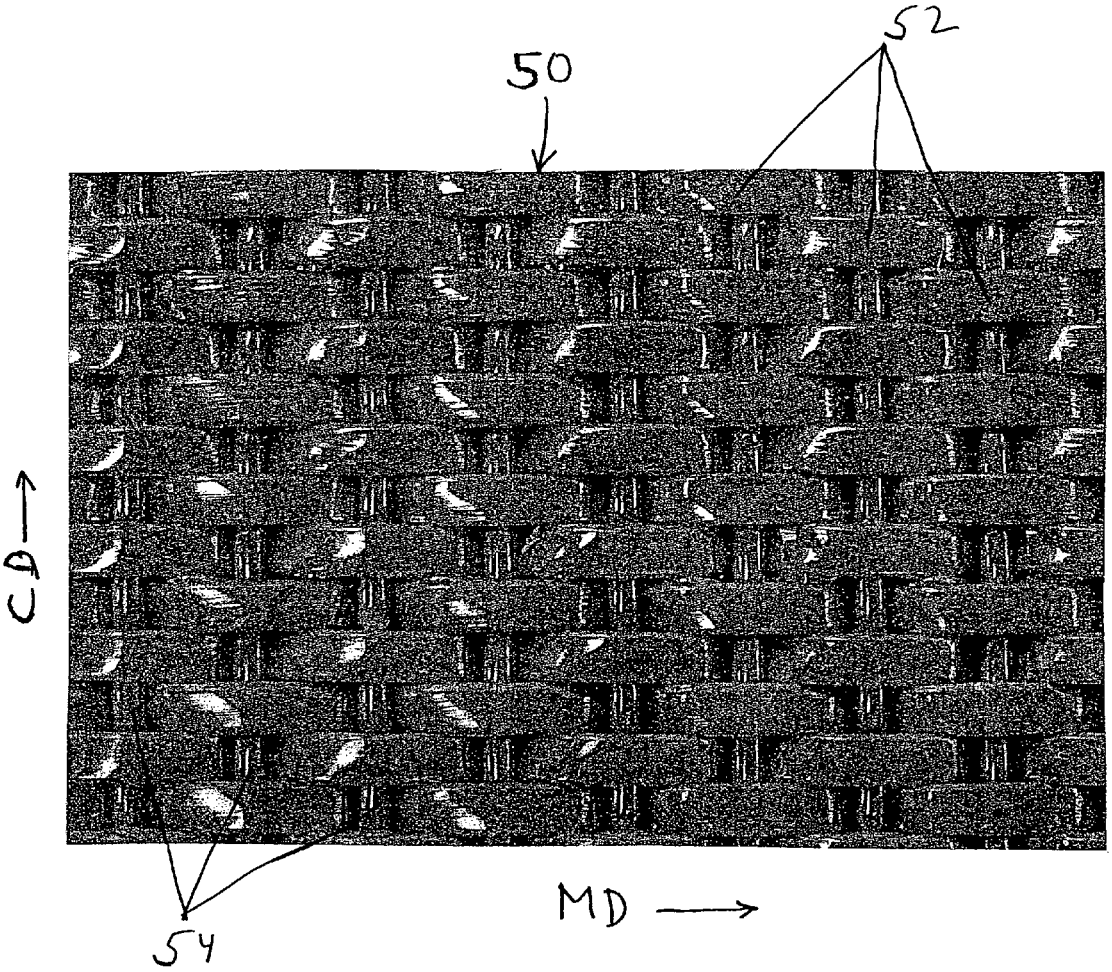
FIG. 5 is a surface photograph of the back or machine side of a papermaker's fabric according to one embodiment of the present invention.

FIG. 5, which depicts the machine side warp yarns of a fabric 50 woven in accordance with the first embodiment of the present invention, shows the machine side coarse warp yarns 52 woven with circular weft yarns 54. From FIG. 5, it can be observed that the fabric 50 has a 100% warp fill on its back or machine side. However, other percentages of warp fill may be achieved within the scope of the present invention.

A fabric constructed in accordance with another embodiment of the present invention may include "grooves" in the machine direction on the sheet contacting side or the machine side of the fabric, resulting in the formation of a quasi warp runner grooved or air channel effect on the fabric. These grooves can be formed by using substantially rectangular yarns of different thicknesses or heights on the same side of the fabric. For instance, the coarse warp yarns on the machine side surface of the fabric may comprise alternating yarns of varying thicknesses or heights such that the fabric has a grooved surface on its machine side for improved air handling. The grooves or ribs on one edge of the fabric seam are preferably aligned with the grooves or ribs on the opposite edge of the fabric to be seamed. Furthermore, MD yarn pairs may be spaced apart from each other to form a "grooved surface" as well as the bottom side layer MD yarns being spaced apart or non-contiguous with adjacent MD yarns.

Figure 6:
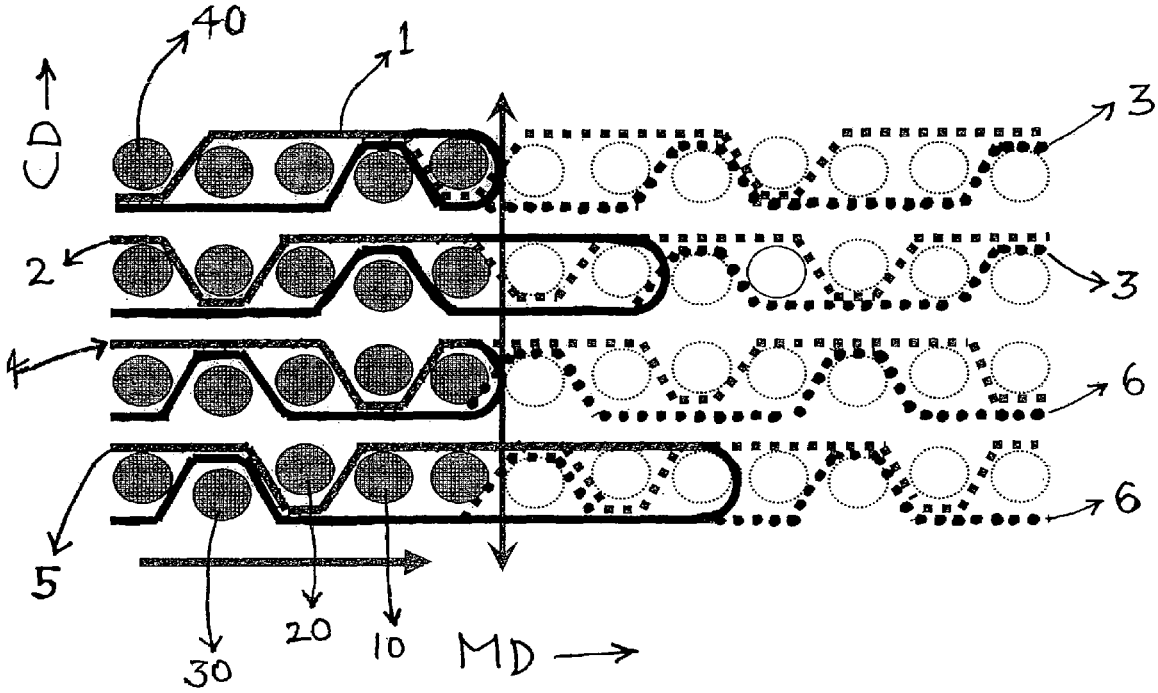
FIG. 6 is a side view in the cross-machine direction of a weave pattern of a seam for a papermaker's fabric according to one embodiment of the present invention.

Depicted in FIG. 6 is one embodiment of a seaming structure for seaming a fabric of the present invention. FIG. 6 shows the formation of a seam, wherein the finer upper layer warp yarns on the sheet contacting side of the fabric 50 form seaming loops at the edge of the fabric that enable the fabric ends to be joined together and formed into an endless loop. To form a seaming loop, one of the warp yarns in a sheet contacting pair of warp yarns or from a shed in the first subsystem of warp yarns, is extended beyond the end of the fabric due to the removal of shute or weft yarns underlying the upper pair of warp yarns. The respective coarse backside or machine side warp yarn that underlies the upper pair of warp yarns is then trimmed back a desired distance from the fabric end. The upper layer warp yarn, which now extends past the edge of the fabric, is then turned back upon itself and rewoven into the backside surface of the fabric in the space vacated by the trimmed coarse backside warp yarn. When the upper finer warp yarns are woven back into the space previously occupied by the lower coarse warp yarns, their crimp and weave pattern matches the pattern of the lower coarse warp yarns, thereby locking the resulting seaming loops in position.

Similarly, the remaining upper warp yarn in the pair of upper warp yarns or from the shed in the first subsystem of warp yarns, which was not used to form the seaming loop is also woven back into the back or machine side surface of the fabric in the space previously occupied by the trimmed coarse backside warp yarn. Because this upper warp yarn is not used to form a seaming loop, it is woven tightly around the last weft or CD yarn remaining at the end of the fabric, into the machine side surface of the fabric. This allows loops formed on the opposite end of the fabric to be interdigitated or intermeshed within the spaces provided by the non-loop forming upper warp yarns in order to seam the fabric via insertion of a pintle through the intermeshed seaming loops.

Prior to weaving the upper layer warp yarns back into the fabric body on the backside of the fabric, the upper warp yarns from the same shed are "twinned" with each other (paired up with each other so that they can weave together as one yarn) and woven back into the backside surface of the fabric in the spaces vacated by the trimmed coarse backside warp yarns. Twinning the pair of upper finer warp yarns from the same shed and weaving the pair as one yarn, allows the weave pattern in the seam area to match the weave pattern of the coarse backside warp yarns in the body of the fabric.

An example of a seam formed according to this embodiment is depicted in FIG. 6, where, alternating upper layer finer warp yarns 2 and 5 are used to create seaming loops at the ends of the fabric, thereby enabling the fabric ends to be joined together into an endless loop. To form the seaming loops, the upper layer finer warp yarns 1, 2, 4 and 5 are extended beyond the end of the fabric due to the removal of CD or weft yarns that underlie the upper paired warp yarns 1, 2 and 4, 5. The respective machine side coarse yarns 3 and 6 are then trimmed back a desired distance from the fabric end in order to create a space for the upper layer finer warp yarns 1, 2, 4 and 5 to weave into. The upper layer finer warp yarns 1, 2, 4 and 5 are then turned back upon themselves and twinned with each other and woven back into the backside surface of the fabric as one yarn in the space vacated by trimmed coarse backside warp yarns 3 and 6. When the twinned upper layer or sheet contacting warp yarns 1, 2, 4 and 5 are woven back into the space previously occupied by the coarse machine side warp yarns 3 and 6, their crimp and weave pattern matches the pattern of the coarse machine side warp yarns 3 and 6. For example, the crimp of upper layer warp yarns 1 and 2 matches coarse machine side warp yarn 3 and the crimp of upper layer warp yarns 4 and 5 matches coarse machine side warp yarn 6, thereby locking the resultant forming loops in position.

Figure 7A:
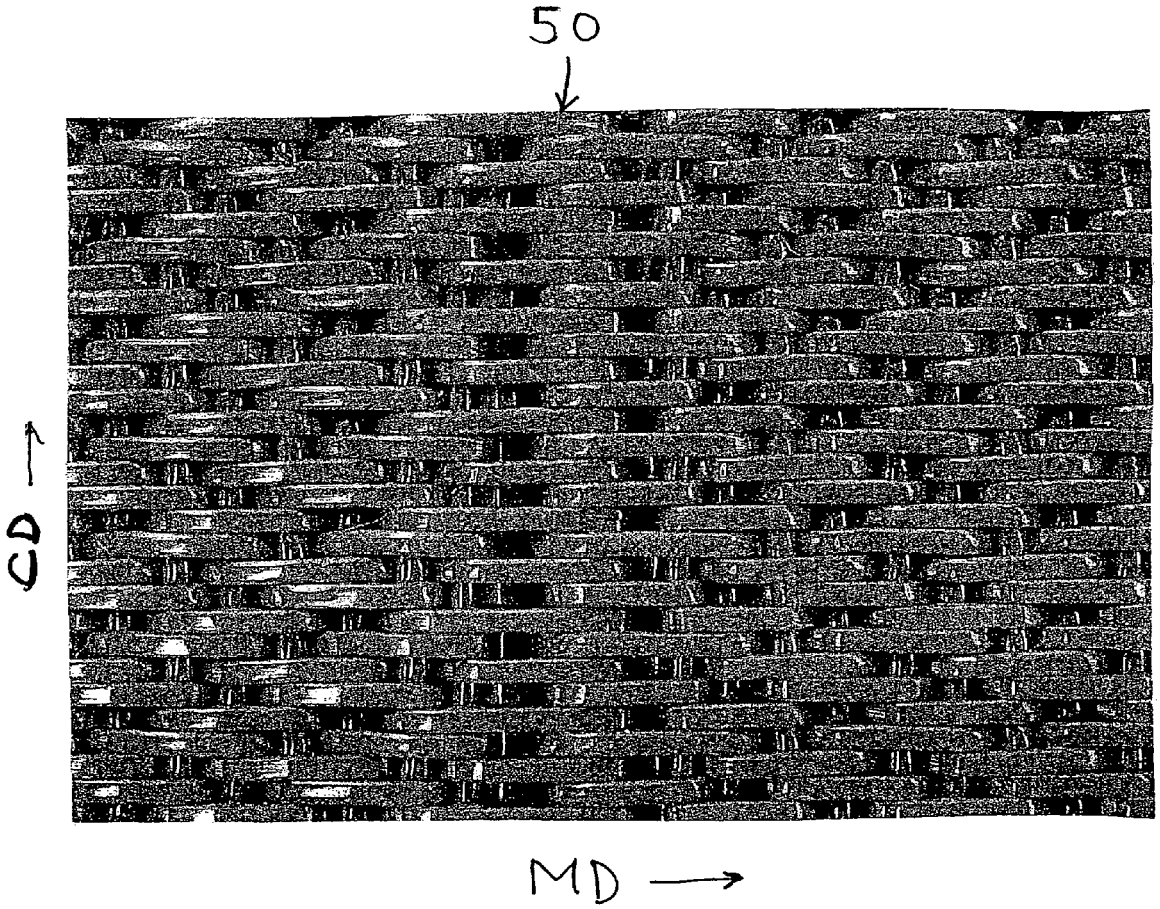
FIG. 7*a* is a surface photograph of the machine side surface of a seam for a papermaker's fabric having the weave pattern depicted in FIG. 6.
Figure 7B:
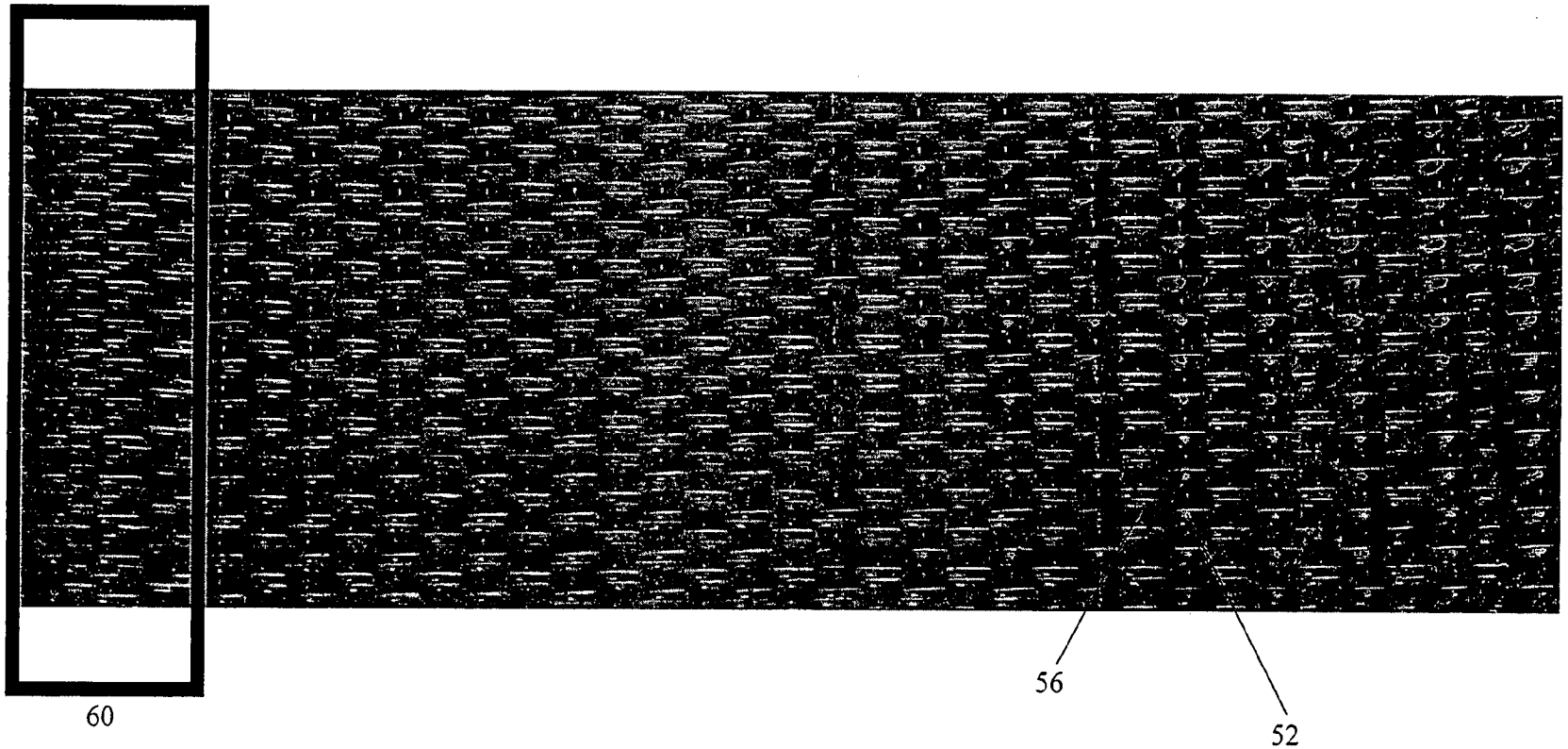
FIG. 7*b* is a surface photograph of the backside surface of a seam area for a papermaker's fabric having the weave pattern depicted in FIG. 6.

As can be further seen in FIG. 6, alternate upper layer warp yarns 1 and 4 are woven back tightly around the last weft or CD yarn remaining at the edge of the fabric, into the machine side surface of the fabric, allowing loops formed on the opposite end of the fabric to be intermeshed in the spaces provided by the non-loop forming finer upper layer warp yarns to seam the fabric via insertion of a pintle through the intermeshed seaming loops. The resulting fabric structure in the seam area on the sheet contacting side surface of the fabric is shown in FIG. 7*a*. FIG. 7*b* is a surface photograph of the backside of fabric 50 in the seam area 60 where the finer face side warp yarns 56 are seen "abutting" coarse backside warp yarns 52 after forming the seaming loops and being twinned with each other and woven back into the fabric body on the backside of the fabric 50 with a crimp and weave pattern that matches the pattern of the coarse backside warp yarns 52. As can be seen in FIG. 7*a*, the paired finer faceside warp yarns are "staggered" as previously described while in FIG. 7*b*, the twinned faceside warp yarns 56 that are woven back into the fabric body both have the same weave pattern, similar to the weave pattern of the coarse backside warp yarns 52.

Because the upper layer or sheet contacting side finer warp yarns and the coarse machine side warp yarns are stacked one on top of the other in a vertical relationship, that is, the sheds in each subsystem of warp yarns are stacked vertically on top of one another, the resultant seaming loops are orthogonal to the plane of the fabric surface and do not have any twist. In conventional back weaving techniques, the loop defining yarns are sometimes back woven into the fabric in a space adjacent to the yarn itself. Such conventional loop formation inherently imparts a twist and/or torque to the seaming loop, which is undesirable because this twist can make intermeshing of seaming loops on opposing ends of the fabric difficult, thereby impeding the seaming process.

Additionally, because the seaming loops are formed from the finer upper layer warp yarns, a very finer seam surface on the sheet contacting side of the fabric is formed. This results in a higher quality paper product due to reduced sheet marking. Consequently, fabrics made in accordance with the present invention can be used to produce paper grades 25 to 30 gsm for example, or above.

Depicted in FIG. 8*a* is a weave pattern for a fabric that can be constructed according to another embodiment of the present invention. Similar to the first embodiment for fabric 50, fabric 100 comprises two subsystems of warp yarns and one system of weft or shute yarns. Both subsystems of warp yarns are flat, substantially rectangular yarns made from polyester, polyamide or any other polymeric resin known in the art. The shute yarns can be either flat (substantially rectangular) or round and can be made from polyester, polyamide or any other polymeric resin known in the art. The sheet contacting side warp yarns or the warp yarns of the first subsystem of warp yarns are the finer yarns and the machine side warp yarns or the warp yarns of the second subsystem of warp yarns are the coarse or wider warp yarns. That is, the substantially rectangular warp yarns in the first subsystem of warp yarns are narrower than the substantially rectangular coarser warp yarns in the second subsystem of warp yarns, which results in the warp yarns of each subsystem having different aspect ratios. For example, the dimensions of a finer upper layer warp yarn may be 0.31 mm high by 0.58 mm wide and the dimensions of a coarser machine side warp yarn may be 0.28 mm high by 1.16 mm wide. Sheet contacting side warp yarns are paired, side-by-side in each shed and are stacked in a vertical relationship with the single coarse yarns in the sheds of the machine side warp yarns, similar to that disclosed for the first embodiment.

FIG. 8*a* depicts a weave pattern for a fabric 100 constructed in accordance with another embodiment of the present invention. In FIG. 8*a*, the machine direction and cross machine direction are as indicated. FIG. 8*a* shows one repeat of the weave pattern of the fabric 100, wherein upper layer warp yarns 1 and 2, which are finer, substantially rectangular yarns on the sheet contacting surface of the fabric, weave over shute yarns 40, 30 and 20, and under shute yarn 10. Substantially rectangular machine side warp yarn 3 weaves over shute yarns 40, 30 and 20, and under shute yarn 10. Upper warp yarns 4 and 5, weave over shute yarn 40, under shute yarn 30 and over shute yarns 20 and 10. Lastly, in this repeat, machine side warp yarn 6 weaves over shute yarn 40, under shute yarn 30, and over shute yarns 20 and 10. Unlike in the first embodiment for fabric 50, the pair of upper warp or MD yarns in this embodiment is not "staggered." Instead the upper warp yarns weave together as a single yarn resulting in each yarn in the pair having the same weave pattern. The fabric 100 may be woven in a 6 harness repeat arrangement. Alternately, the fabric 100 may also be woven in other harness repeat arrangements, for example, with a 4 harness repeat arrangement.

The weave design for the sheet contacting side and the machine side of the fabric are depicted in FIGS. 8*b* and 8*c*, respectively, in order to show a comparative warp fill on the sheet contacting side and machine side of the fabric. For example, the width of a substantially rectangular bottom layer coarse warp yarn is approximately equal to twice the width of each substantially rectangular finer warp yarn in the upper layer. The weave pattern depicted in FIG. 8*a* can be seen throughout the face side of the fabric structure, except for portions in the seaming area on the backside of the fabric where the upper warp yarns abut lower coarser warp yarns. The pin seam in fabric 100 is formed according to the method described above for the formation of the pin seam in fabric 50. Alternatively, fabrics 50 and 100 can be formed using a spiral seam as discussed in the background.

A variety of other weave patterns employing the paired stacked weave construction of the instant invention may be constructed within the scope of the present invention. For example, in some applications it may be desirable to have MD yarn surface floats over four or more CD yarns. Such fabrics are readily constructed in accordance with the teachings of the present invention.

Figure 9:
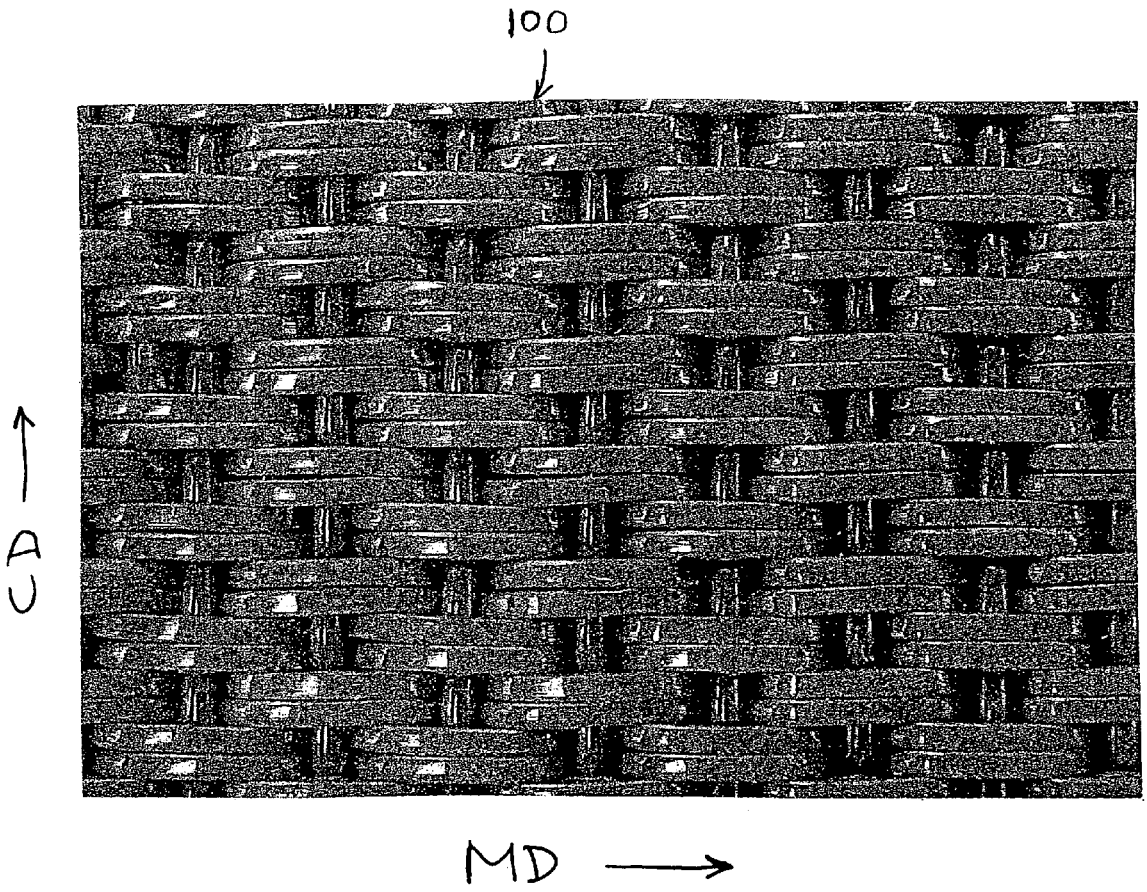
FIG. 9 is a surface photograph of a papermaker's fabric according to one embodiment of the present invention.
Figure 10:
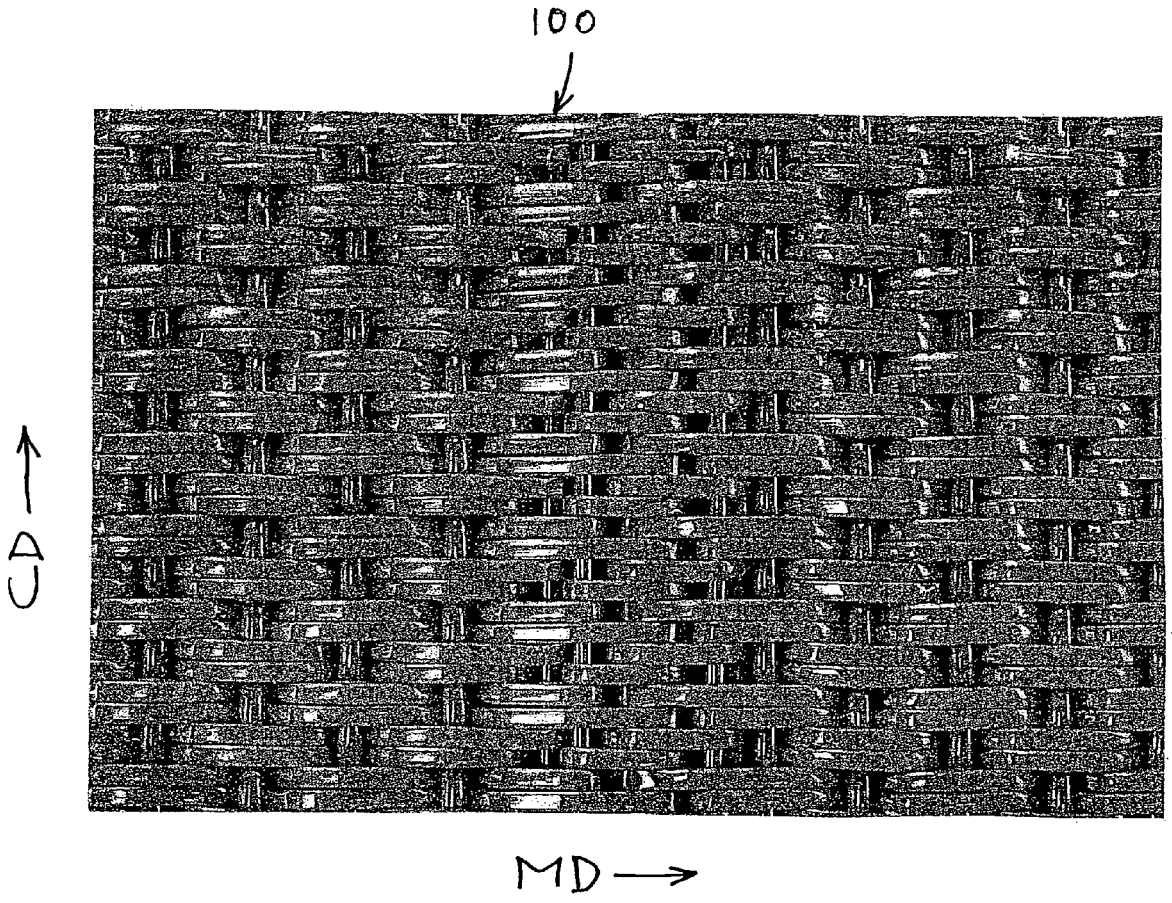
FIG. 10 is a surface photograph of a seam of a papermaker's fabric according to one embodiment of the present invention.

As depicted in FIGS. 9 and 10, the sheet contacting side surface and the seam profile achieved according the instant embodiment of the present invention is similar to that of fabric 50. As can be seen in FIG. 10, the finer machine side warp yarns that weave back into the backside surface are twinned with each other prior to weaving so that the weave pattern of the finer machine side warp yarns is similar to the weave pattern of the coarse backside yarns.

Both fabrics 50 and 100 may be used with a single run or single tier dryer section. Alternatively, the fabric 50 and/or 100 may be used with other types of dryer sections, such as that shown in FIG. 1*a*. As is to be appreciated, in such situation, fabric 99 would be replaced with fabrics 50 or 100.

Additionally, the MD yarns and the CD yarns may be interwoven such that the MD and CD yarn knuckles lie in substantially the same plane. Such arrangement may provide a relatively smooth surface. Alternatively, the MD yarns and the CD yarns may be interwoven such that the CD yarn knuckles lie in a plane higher (or closer to the surface) than that of the MD knuckles. Specifically, the weave pattern of the fabric according to the present invention can be a monoplane, differential plane, warp runner or a shute runner structure or a combination of these structures. Warp runner structures have longer warp knuckles on the backside and shute runner structures are those with longer CD floats on back side of the fabric. Additionally, face side MD yarns can be contiguous as shown in FIGS. 4, 7, 9 and 10 or can be spaced apart either as pairs or in between all yarns, yet keeping the vertically stacked position of sheet side yarn pairs over a machine side yarn so that machine side yarns are spaced accordingly.

Modifications to the above would be obvious to those of ordinary skill in the art, but would not bring the invention so modified beyond the scope of the present invention. For example, while fabric 50 and 100 may be flat woven and joined into endless form for use on the dryer section of a paper machine, it is also possible to produce the fabric 50 and/or 100 by endless weaving, in which case the MD yarns would be weft or shute yarns during the weaving process and the CD yarns would be warp yarns. The claims to follow should be construed to cover such a situation.

What is claimed is:

1. A papermaker's fabric comprising:

a system of CD yarns comprised of a plurality of CD yarns; and a system of MD yarns, wherein said system of MD yarns further comprises a first subsystem of MD yarns and a second subsystem of MD yarns;

wherein said first subsystem comprises sheds having at least two MD yarns, said at least two MD yarns of said first subsystem having substantially similar aspect ratios;

wherein MD yarns of said second subsystem have an aspect ratio greater than that of said at least two MD yarns of said first subsystem;

wherein said at least two MD yarns of said first subsystem are on top of a single MD yarn in said second subsystem in a vertically stacked relationship:

wherein said first and second subsystems of MD yarns are interwoven with said CD yarns in said system of CD yarns in a repeat weave pattern; and wherein only said MD yarns of said first subsystem form seaming loops.

2. The papermaker's fabric as in claim 1, wherein said MD yarns of said first subsystem float over at least two consecutive CD yarns in said system of CD yarns when interweaving therewith within said repeat pattern.

3. The papermaker's fabric as in claim 1, wherein yarns in said systems of MD and CD yarns are selected from the group consisting of polyamide yarns, polyester yarns, polyphenylene sulfide yarns, modified heat , hydrolysis and contaminant resistant polyester yarns, poly(cyclohexanedimethylene terephthalateisophthalate) yarns, and polyetheretherketone yarns.

4. The papermaker's fabric as in claim 1, wherein at least some of said CD yarns are monofilament yarns having either a circular cross-sectional shape or a substantially rectangular cross-sectional shape.

5. The papermaker's fabric as in claim 1, wherein said fabric is a dryer fabric.

6. The papermaker's fabric as in claim 1, wherein said second subsystem of MD yarns are disposed on a backside or machine side of the fabric.

7. The papermaker's fabric as in claim 1, wherein said first subsystem of MD yarns are disposed on a sheet contacting side of the fabric.

8. The papermaker's fabric as in claim 1, wherein said MD yarns of said first subsystem are paired in a side-by-side relationship in each shed.

9. The papermaker's fabric as in claim 3, wherein yarns in said systems of MD and CD yarns are made of different materials.

10. The papermaker's fabric as in claim 8, wherein each yarn in said MD yarn pairs of said first subsystem has a different weave pattern.

11. The papermaker's fabric as in claim 10, wherein each yarn in said MD yarn pairs of said first subsystem is staggered in relation to each other.

12. The papermaker's fabric as in claim 8, wherein each yarn in said MD yarn pairs of said first subsystem is woven as one with the same weave pattern.

13. The papermaker's fabric as in claim 1, wherein said weave pattern forms one of monoplane, warp runner and shute runner structures.

14. The papermaker's fabric as in claim 1, wherein some of said MD yarns in said second subsystem have the same width but different thicknesses.

15. The papermaker's fabric as in claim 1, wherein said seam is either a pin seam or a spiral seam.

16. A method of forming a papermaker's fabric, said method comprising the steps of:

providing a system of CD yarns comprising a plurality of CD yarns;

providing a system of MD yarns, wherein said system of MD yarns further comprises a first subsystem of MD yarns and a second subsystem of MD yarns, wherein said first subsystem comprises sheds having at least two MD yarns, said at least two MD yarns of said first subsystem having substantially similar aspect ratios, wherein said MD yarns of said second subsystem have an aspect ratio greater than that of said at least two MD yarns in said first subsystem, wherein said at least two MD yarns of said first subsystem are on top of a single MD yarn in said second subsystem in a vertically stacked relationship;

interweaving said first and second subsystems of MD yarns with said system of CD yarns in a repeat weave pattern; and forming seaming loops from only said MD yarns of said first subsystem.

17. The method as in claim 16, wherein said MD yarns of said first subsystem float over at least two consecutive CD yarns in said system of CD yarns when interweaving therewith within said repeat pattern.

18. The method as in claim 16, wherein yarns in said systems of MD and CD yarns are selected from the group consisting of polyamide yarns, polyester yarns, polyphenylene sulfide yarns, modified heat, hydrolysis and contaminant resistant polyester yarns, poly(cyclohexanedimethylene terephthalateisophthalate) yarns, and polyetheretherketone yarns.

19. The method as in claim 16, wherein at least some of said CD yarns are monofilament yarns having either a circular cross-sectional shape or a substantially rectangular cross-sectional shape.

20. The method as in claim 16, wherein said fabric is a dryer fabric.

21. The method as in claim 16, wherein said second subsystem of MD yarns are disposed on a backside or machine side of the fabric.

22. The method as in claim 16, wherein said first subsystem of MD yarns are disposed on a sheet contacting side of the fabric.

23. The method as in claim 16, wherein said MD yarns of said first subsystem are paired in a side-by-side relationship in each shed.

24. The method as in claim 18, wherein yarns in said systems of MD and CD yarns are made of different materials.

25. The method as in claim 23, wherein each yarn in said MD yarn pairs of said first subsystem is woven with a different weave pattern.

26. The method as in claim 25, wherein each yarn in said MD yarn pairs of said first subsystem is woven having a staggered relationship.

27. The method as in claim 23, wherein each yarn in said MD yarn pairs of said first subsystem is woven as one with the same weave pattern.

28. The method as in claim 16, wherein said weave pattern forms one of monoplane, warp runner and shute runner structures.

29. The method as in claim 16, wherein some of said MD yarns in said second subsystem have the same width but different thicknesses.

30. The method as in claim 16, wherein said seam is either a pin seam or a spiral seam.

31. The method as in claim 23, wherein said paired MD yarns of said first system are twinned with each other prior to weaving back into a backside surface of the fabric.

32. The method as in claim 31, wherein said twinned MD yarns of said first subsystem are woven back into the backside surface of the fabric with a weave pattern which is the same as or similar to that of the MD yarns of the second subsystem.

33. A seam for use in an industrial fabric, said seam comprising:

a first system of MD yarns that form seaming loops in said seam, wherein said first system comprises sheds having at least two MD yarns, said at least two MD yarns of said first system having substantially similar aspect ratios; and a second system of MD yarns having an aspect ratio greater than that of said at least two MD yarns of said first system, wherein said at least two MD yarns of said first system are on top of a single MD yarn in said second system in a vertically stacked relationship, wherein only said MD yarns of said first subsystem form seaming loops.

34. The seam as in claim 33, further comprising a system of CD yarns comprised of a plurality of CD yarns, wherein said first and second systems of MD yarns are interwoven with said CD yarns in said system of CD yarns in a repeat weave pattern.

35. The seam as in claim 34, wherein yarns in said systems of MD and CD yarns are selected from the group consisting of polyamide yarns, polyester yarns, polyphenylene sulfide yarns, modified heat, hydrolysis and contaminant resistant polyester yarns, poly(cyclohexanedimethylene terephthalateisophthalate) yarns, and polyetheretherketone yarns.

36. The seam as in claim 33, wherein said second system of MD yarns are disposed on a backside or machine side of the industrial fabric.

37. The seam as in claim 33, wherein said first system of MD yarns are disposed on a sheet contacting side of the industrial fabric.

38. The seam as in claim 33, wherein said MD yarns of said first system are paired in a side-by-side relationship in each shed.

39. The seam as in claim 35, wherein yarns in said systems of MD and CD yarns are made of different materials.

40. The seam as in claim 38, wherein each yarn in said MD yarn pairs of said first system has a different weave pattern.

41. The seam as in claim 38, wherein each yarn in said MD yarn pairs of said first system is woven as one with the same weave pattern.

42. The seam as in claim 33, wherein some of said MD yarns in said second system have the same width but different thicknesses.

43. The seam as in claim 33, wherein said seam is either a pin seam or a spiral seam.

44. The seam as in claim 33, wherein said industrial fabric is a papermaker's fabric.

45. The seam as in claim 44, wherein said papermaker's fabric is a forming, press or dryer fabric.

* * * * *